US012297156B2

(12) United States Patent
Halander et al.

(10) Patent No.: US 12,297,156 B2
(45) Date of Patent: May 13, 2025

(54) MECHANICALLY GASSED EMULSION EXPLOSIVES AND RELATED METHODS AND SYSTEMS

(71) Applicant: Dyno Nobel Inc., Salt Lake City, UT (US)

(72) Inventors: John Halander, Salt Lake City, UT (US); Casey L. Nelson, Murray, UT (US); Jeremiah R. Beagley, Huntington, UT (US); Cornelis Kome, Salt Lake City, UT (US)

(73) Assignee: Dyno Nobel Inc., Salt Lake City, UT (US)

( * ) Notice: Subject to any disclaimer, the term of this patent is extended or adjusted under 35 U.S.C. 154(b) by 252 days.

(21) Appl. No.: 17/819,517

(22) Filed: Aug. 12, 2022

(65) Prior Publication Data

US 2023/0159407 A1 May 25, 2023

Related U.S. Application Data

(60) Provisional application No. 63/364,014, filed on May 2, 2022, provisional application No. 63/237,079, filed on Aug. 25, 2021.

(51) Int. Cl.

| | |
|---|---|
| ***C06B 21/00*** | (2006.01) |
| ***F42D 1/10*** | (2006.01) |
| ***F42D 3/04*** | (2006.01) |

(52) U.S. Cl.

CPC ..... *C06B 21/0008* (2013.01); *F42D 1/10* (2013.01); *F42D 3/04* (2013.01)

(58) Field of Classification Search

CPC ..... C06B 21/0008; C06B 47/145; F42D 1/10; F42D 3/04

See application file for complete search history.

(56) References Cited

U.S. PATENT DOCUMENTS

| | | | |
|---|---|---|---|
| 3,004,842 | A | 10/1961 | Charles |
| 3,397,097 | A | 8/1968 | Atadan et al. |
| 3,447,978 | A | 6/1969 | Bluhm |
| 3,545,838 | A | 12/1970 | Levin et al. |
| 3,783,053 | A | 1/1974 | Oettmeier et al. |
| 3,788,909 | A | 1/1974 | Wasson et al. |
| 4,072,243 | A | 2/1978 | Conant et al. |

(Continued)

FOREIGN PATENT DOCUMENTS

| | | |
|---|---|---|
| CA | 2294893 A1 | 1/1999 |
| EP | 0157594 A2 | 10/1985 |

(Continued)

OTHER PUBLICATIONS

Extended European Search Report dated Sep. 8, 2021 for EP19743345.1.

(Continued)

*Primary Examiner* — Carib A Oquendo

(74) *Attorney, Agent, or Firm* — Dorsey & Whitney LLP

(57) ABSTRACT

Emulsion explosives with gas bubbles that are resistant to in-borehole migration or coalescence are disclosed herein. Such emulsions can be sensitized by mechanically introducing gas bubbles into the emulsion. Gassing can be performed at any of multiple points from initial formation of the emulsion to delivery of the emulsion into the borehole. Resistance to gas bubble migration and coalescence can be achieved by homogenization, without the need for bubble stabilization agents.

18 Claims, 5 Drawing Sheets

(56) References Cited

U.S. PATENT DOCUMENTS

| | | | |
|---|---|---|---|
| 4,084,934 | A | 4/1978 | Kumazawa |
| 4,118,447 | A | 10/1978 | Richter |
| 4,125,640 | A | 11/1978 | Conant et al. |
| 4,195,548 | A | 4/1980 | Clay et al. |
| 4,259,977 | A | 4/1981 | Brockington |
| 4,273,147 | A | 6/1981 | Olney |
| 4,491,489 | A | 1/1985 | Ellis et al. |
| 4,521,349 | A | 6/1985 | Weber et al. |
| 4,555,278 | A | 11/1985 | Cescon et al. |
| 4,676,847 | A | 6/1987 | Lin |
| 4,676,849 | A | 6/1987 | Curtin et al. |
| 4,693,765 | A | 9/1987 | Stromquist et al. |
| 4,780,156 | A | 10/1988 | Sheeran et al. |
| 4,790,891 | A | 12/1988 | Halliday et al. |
| 4,840,687 | A | 6/1989 | Forsberg et al. |
| 4,848,749 | A | 7/1989 | Schneider |
| 4,867,920 | A | 9/1989 | Sudweeks et al. |
| 4,936,933 | A | 6/1990 | Yabsley et al. |
| 4,966,077 | A | 10/1990 | Halliday et al. |
| 4,997,494 | A | 3/1991 | Nguyen |
| 5,151,187 | A | 9/1992 | Behmann |
| 5,322,576 | A | 6/1994 | Aitken et al. |
| 5,346,564 | A | 9/1994 | Vance et al. |
| 5,366,571 | A | 11/1994 | Ruhe et al. |
| 5,524,523 | A | 6/1996 | Luebbe et al. |
| 5,686,685 | A | 11/1997 | Mcdonald et al. |
| 5,874,688 | A | 2/1999 | Luebbe et al. |
| 6,113,715 | A | 9/2000 | Halander et al. |
| 6,210,122 | B1 | 4/2001 | Broendbo |
| 6,261,393 | B1 | 7/2001 | Vestre |
| 6,372,842 | B1 | 4/2002 | Grisso et al. |
| 6,397,754 | B1 | 6/2002 | Perlid |
| 6,435,096 | B1 | 8/2002 | Watson |
| 6,520,089 | B1 | 2/2003 | Avanci et al. |
| 6,539,870 | B1 | 4/2003 | Granholm |
| 6,557,448 | B2 | 5/2003 | Delagey et al. |
| 6,651,564 | B1 | 11/2003 | Tite et al. |
| 6,783,799 | B1 | 8/2004 | Goodson |
| 6,808,573 | B2 | 10/2004 | Hales et al. |
| 6,877,432 | B2 | 4/2005 | Thomson et al. |
| 6,913,251 | B2 | 7/2005 | Kerfoot |
| 6,942,744 | B2 | 9/2005 | Palmer |
| 6,949,153 | B2 | 9/2005 | Gomez et al. |
| 7,459,496 | B2 | 12/2008 | Hsu et al. |
| 7,645,380 | B2 | 1/2010 | Kerfoot |
| 7,771,550 | B2 | 8/2010 | Halander et al. |
| 7,980,312 | B1 | 7/2011 | Hill et al. |
| 8,096,119 | B2 | 1/2012 | Baughman et al. |
| 8,114,231 | B2 | 2/2012 | Da Silva et al. |
| 8,235,117 | B1 | 8/2012 | Hill et al. |
| 8,261,823 | B1 | 9/2012 | Hill et al. |
| 8,276,517 | B2 | 10/2012 | Poleg et al. |
| 8,381,653 | B2 | 2/2013 | Zimmermann |
| 8,403,904 | B2 | 3/2013 | Tian et al. |
| 8,512,489 | B2 | 8/2013 | Rancourt |
| 8,647,317 | B2 | 2/2014 | Tian et al. |
| 8,678,354 | B2 | 3/2014 | Kerfoot |
| 8,820,242 | B2 | 9/2014 | Alexander |
| 9,085,972 | B1 | 7/2015 | Hill et al. |
| 9,207,055 | B2 | 12/2015 | Halander et al. |
| 2002/0009622 | A1 | 1/2002 | Goodson |
| 2004/0055678 | A1 | 3/2004 | Hales et al. |
| 2004/0174171 | A1 | 9/2004 | Desie et al. |
| 2004/0247534 | A1 | 12/2004 | Stoltz |
| 2007/0277916 | A1 | 12/2007 | Halander et al. |
| 2010/0296362 | A1 | 11/2010 | Halander et al. |
| 2011/0132505 | A1 | 6/2011 | Dlugogorski et al. |
| 2013/0327456 | A1 | 12/2013 | Goodridge et al. |
| 2014/0155259 | A1 | 6/2014 | Tian et al. |
| 2014/0216289 | A1 | 8/2014 | Halander et al. |
| 2014/0311634 | A1 | 10/2014 | Mcphail et al. |
| 2014/0367604 | A1 | 12/2014 | Alexander |
| 2015/0101993 | A1 | 4/2015 | Fabiyi |
| 2016/0033249 | A1 | 2/2016 | Alexander |
| 2016/0145165 | A1 | 5/2016 | Zank et al. |
| 2017/0204020 | A1 | 7/2017 | Senules |
| 2019/0233347 | A1 | 8/2019 | Halander et al. |
| 2022/0363610 | A1 | 11/2022 | Halander et al. |

FOREIGN PATENT DOCUMENTS

| | | | |
|---|---|---|---|
| EP | 0322097 | B1 | 1/1994 |
| EP | 1207145 | | 7/1999 |
| EP | 1002777 | A1 | 5/2000 |
| GB | 1362352 | A | 8/1974 |
| WO | 2001060504 | | 8/2001 |
| WO | 2007086950 | A2 | 8/2007 |
| WO | 2013013272 | A1 | 1/2013 |
| WO | 2014123562 | A1 | 8/2014 |
| WO | 2015140462 | A1 | 9/2015 |
| WO | 2019201851 | A1 | 10/2019 |

OTHER PUBLICATIONS

International Search Report and Written Opinion dated May 13, 2019 for PCT/US2019/015241.

International Search Report and Written Opinion dated Nov. 30, 2022 for PCT/US2022/074895.

Bhandari , "Engineering Rock Blasting Operations", Depart of Mining Engineering, J.N.V. University, Jodhpur, India, A.A. Balkema/Rotterday/Brookfield, 1997.

MECHANICALLY GASSED EMULSION EXPLOSIVES AND RELATED METHODS AND SYSTEMS

RELATED APPLICATIONS

This application claims priority to U.S. Provisional Patent Application No. 63/364,014, titled MECHANICALLY GASSED EMULSION EXPLOSIVES AND RELATED METHODS AND SYSTEMS, filed May 2, 2022, and to U.S. Provisional Patent Application No. 63/237,079, titled MECHANICALLY GASSED EMULSION EXPLOSIVES AND RELATED METHODS, filed Aug. 25, 2021, each of which is incorporated herein by reference in its entirety.

TECHNICAL FIELD

The present disclosure relates generally to the field of explosive compositions. More particularly, the present disclosure relates to mechanically gassed emulsion explosives and methods related thereto.

BRIEF DESCRIPTION OF THE DRAWINGS

To easily identify the discussion of any particular element or act, the most significant digit or digits in a reference number refer(s) to the figure number in which that element is first introduced.

DETAILED DESCRIPTION

Figure 1:
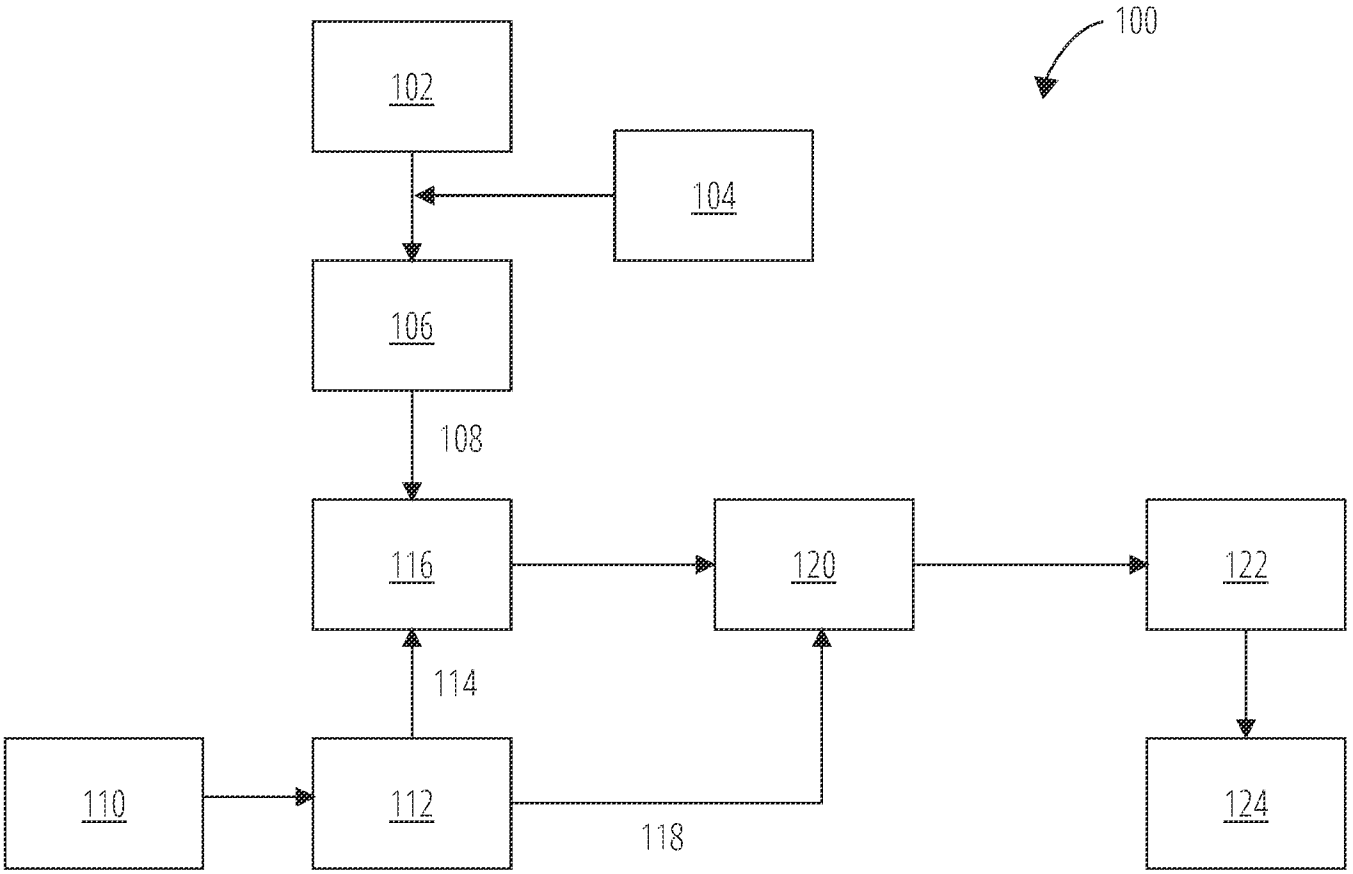
FIG. 1 illustrates a process for delivering an emulsion explosive in accordance with one embodiment.

This disclosure generally relates to water-in-oil (or melt-in-oil) emulsions for use as explosives, along with related methods. The term "water-in-oil" means a dispersion of droplets of an aqueous solution or water-miscible melt (the discontinuous phase) in an oil or water-immiscible organic substance (the continuous phase). The water-in-oil emulsion explosives of this invention contain a water-immiscible organic fuel as the continuous phase and an emulsified inorganic oxidizer salt solution or melt as the discontinuous phase. (The terms "solution" or "melt" hereafter shall be used interchangeably.)

The phrase "fluid communication" is used in its ordinary sense, and is broad enough to refer to arrangements in which a fluid (e.g., a gas or a liquid) can flow from one element to another element.

The term "proximal" is used herein to refer to "near" or "at" the object disclosed. For example, "proximal the outlet of the conduit" refers to near or at the outlet of the conduit.

Emulsion explosives are commonly used in the mining, quarrying, and excavation industries for breaking rocks and ore. Generally, a hole, referred to as a "borehole" or "blast hole," is drilled in a surface, such as the ground or a rock face. Emulsion explosives may then be pumped or augered into the borehole. Emulsion explosives are generally transported to a job site or made on the job site as an emulsion that is too dense to completely detonate, referred to as an emulsion matrix. In general, the emulsion matrix needs to be "sensitized," i.e., subjected to a treatment or process that lowers its density, in order for the emulsion matrix to detonate successfully. A sensitized emulsion matrix is considered an emulsion explosive.

Sensitizing is often accomplished by introducing small voids into the emulsion matrix. These voids act as hot spots for propagating detonation. These voids may be introduced by injecting a gas into the emulsion and thereby forming discrete gas bubbles, adding microspheres, other porous media, and/or injecting chemical gassing agents to react in the emulsion and thereby form discrete gas bubbles. While sensitization is commonly performed as a latter stage in the preparation of an emulsion explosive, the present disclosure describes processes in which sensitization is initiated at an earlier stage, such as during creation of the initial emulsion.

The emulsion explosive can be designed to be manufactured on site. This is referred to as a site-mixed emulsion. In site mixing methods, pressures employed in making the emulsion matrix may result in residual pressures that provide sufficient kinetic energy to complete processing of the emulsion explosive and deliver the emulsion explosive to a borehole.

In the present disclosure, the introduction of gas bubbles into the emulsion matrix may be accomplished mechanically, such as via compressed gas that is delivered to the emulsion matrix during manufacture. Particularly, compressed gas may be introduced in conjunction with a component of the emulsion matrix. For example, compressed gas may be used to bring the component into contact with other components, and may further facilitate mixing of the components to form a sensitized emulsion explosive. The sensitized emulsion explosive may then be subjected to shear stress, thereby increasing the viscosity of the emulsion explosive. The resulting homogenized emulsion explosive may be used for any suitable purpose, such as for detonation in boreholes.

In some embodiments, the homogenized emulsion explosive lacks or is substantially devoid of gas bubble stabilizing agents, such as haloalkyl esters, (including fluoroaliphatic polymer esters), small particles (such as silica particles, iodipamide ethyl ester particles, and various colloidal particles), and proteins. In some embodiments, the homogenized emulsion includes emulsifiers, homogenizing agents, or both. Specific features of particular embodiments of this disclosure are discussed in additional detail below. The phrase "bubble stabilizing agent" or "foaming agent" refers to a composition that reduces the rate of bubble coalescence in a gas-infused emulsion relative to an essentially identical gas-infused emulsion that lacks the bubble stabilizing agent.

In contrast to bubble stabilizing agents, in some embodiments, the emulsion comprises an emulsifier, a homogenizing agent, or both. The phrase "homogenizing agent" refers to a composition that promotes an increase in viscosity of an emulsion upon subjection of the emulsion to shear stress. Such homogenizing agents may promote the formation of relatively small droplets of the oxidizer phase upon subjection of the emulsion to shear stress. The term "emulsifier" refers to a composition that stabilizes the liquid interface between different liquids in an emulsion. In some cases, a composition may function as both a homogenizing agent and an emulsifier.

In some embodiments, a homogenized emulsion explosive having a relatively high viscosity may be manufactured by first forming a relatively low viscosity emulsion explosive that includes a discontinuous phase of oxidizer salt solution droplets in a continuous phase of a fuel. The fuel may be a mixture of a diesel fuel (which may alternatively be referred to as "fuel oil") and an emulsifier, such as a fatty acid. In some embodiments, the emulsion matrix is about 90% to about 96% oxidizer salt solution and about 4%-10% fuel (weight per weight), such as about 94% oxidizer salt solution and about 6% fuel. In some embodiments, the oxidizer salt solution is about 70% to about 90% ammonium nitrate by weight.

In some embodiments, the homogenized emulsion explosive lacks a bubble stabilizing agent. By way of example, the homogenized emulsion explosives may be devoid of any haloalkyl esters, small particles, and proteins. The excluded small particles may range in size from submicron (e.g., 20 nm) to 50 microns in size. Stated differently, the homogenized emulsion explosives may lack foaming agents or surfactants that stabilize gas bubbles in the emulsion.

The emulsifier may be chosen from any suitable emulsifier and may be part of the fuel, and thus, part of the continuous phase. For example, the fuel may include up to 25 weight percent of an emulsifier, homogenizing agent, or both. For example, the homogenizing agent may be from 20 percent to 100 percent of the emulsifier/homogenizing agent in the fuel. Thus, for example, when the fuel is about 6 weight percent of the homogenized emulsion, the homogenizing agent may be about 0.3% to about 1.5% of the homogenized emulsion, by weight.

Examples of emulsifiers and homogenizing agents that may be selected for use include alcohol alkoxylates, phenol alkoxylates, poly(oxyalkylene) glycols, poly(oxyalkylene) fatty acid esters, amine alkoxylates, fatty acid esters of sorbitol and glycerol, fatty acid salts, sorbitan esters, poly (oxyalkylene) sorbitan esters, fatty amine alkoxylates, poly (oxyalkylene)glycol esters, fatty acid amides, fatty acid amide alkoxylates, fatty amines, quaternary amines, alkyloxazolines, alkenyloxazolines, imidazolines, alkylsulfonates, alkylarylsulfonates, alkylsulfosuccinates, alkylphosphates, alkenylphosphates, phosphate esters, lecithin, copolymers of poly(oxyalkylene) glycols, and poly(12-hydroxystearic acid). In some embodiments, the emulsifier is polyisobutenyl succinic anhydride (PIBSA). In some embodiments, the emulsifier is sorbitan monooleate.

In some embodiments, methods and systems for manufacturing a mechanically-gassed emulsion explosive can involve a process flow in which atomization is employed to accomplish the formation and sensitization of the emulsion. Atomization generally describes processes for dispersing a liquid into a dispersion of fine droplets. This can involve forcing a liquid under pressure through an atomization nozzle having a relatively small orifice, wherein the pressure drop upon exiting the nozzle results in the creation of liquid droplets. The degree of atomization achieved can depend upon a number of factors including orifice size, magnitude of pressure drop across the orifice, and fluid characteristics such as density, viscosity, and surface tension.

Atomization of a liquid can also involve mixing the liquid with an atomizing medium e.g., a gas. The gas can be present in a state that provides additional dispersive energy, such as a pressurized gas or other expanding gaseous medium, like steam. Atomization can further include one or more stages of impingement between the liquid stream and gas stream, as well as other means of producing agitation or shearing to enhance dispersion of the gas throughout the liquid. In some applications each gas stream contacts a liquid stream at high velocity, and can involve impingement from a plurality of angles.

A number of atomization methods and apparatus are used in industrial processes, all of which are encompassed by the present disclosure. Atomizers can be classified by whether they employ internal mixing or external mixing. In internal mixing atomizers, the gas stream and the liquid stream are introduced into a mixing chamber where vigorous agitation takes place at relatively high velocities to create a finely atomized mixture. In external mixing atomizers, the liquid stream is discharged from a nozzle and is then subjected to the atomizing gas stream.

FIG. 1 shows a process flow 100 in accordance with an embodiment. A liquid fuel 102 is provided for use as the continuous phase of the emulsion explosive. Any fuel phase known in the art and compatible with the oxidizer phase and an emulsifier, if present, may be used. Examples of liquid fuel include, but are not limited to, fuel oil, diesel oil, distillate, mineral oil, furnace oil, kerosene, gasoline, naphtha, and mixtures thereof. In some embodiments, the fuel 102 may be a diesel fuel.

In some embodiments, the fuel can further comprise an emulsifier, a homogenizing agent, or both. In some embodiments, the fuel 102 is substantially devoid of a bubble stabilizing agent. The process flow 100 can comprise atomizing the fuel 102, wherein a stream of fuel 102 and a stream of gas 104 are directed to an atomizer 106, where they are combined to form an atomized fuel stream 108. In some embodiments the gas 104 can be a compressed gas, such as compressed nitrogen, helium, a noble gas, or compressed air. The atomized fuel stream 108 is then discharged into a first mix zone 116 for incorporation into an emulsion explosive.

Atomization can be facilitated using an apparatus suited to accomplish a level of mixing of the fuel 102 and the gas 104 at a desired throughput. In various embodiments, a mixture of compressed gas 104 and fuel 102 are passed through one or more atomizer nozzles. In some embodiments, a plurality of atomizer nozzles are arranged so that the mixture flows through the plurality in parallel, in series, or a combination of both. In some embodiments, atomization is performed using a plurality comprising 2 to 13 atomizer nozzles, or 3 to 7 atomizer nozzles. The orifice size of the nozzle(s) may be selected to provide a particular degree of atomization as discussed above. Orifice size will also affect the nozzle's throughput. Accordingly, orifice size can be selected in combination with nozzle number to determine these output parameters. In some embodiments, atomization is performed using nozzles having an orifice diameter of about 0.03125 inches to about 0.15625 inches, or more particularly about 0.0625 inches to about 0.1250 inches. In an embodiment, atomization is performed to provide an atomized fuel stream at a production rate of about 300 lb/min.

FIG. 2A-FIG. 2H show various views of an example of an atomizer assembly 200 that may be used to produce the atomized fuel stream 108 and introduce said stream into the first mix zone 116. As shown in the cross-section view of FIG. 2A, the atomizer assembly 200 can comprise an inlet 202 for a mixture of compressed gas (e.g., compressed air) and fuel to enter the assembly. The mixture passes through at least one atomizer nozzle 204, by which the mixture is atomized. Each atomizer nozzle 204 can be supported by a nozzle plate 206. As shown in the transverse cross-section view taken at level A-A (FIG. 2B), the nozzle plate 206 can support a plurality of atomizer nozzles 204. The atomizer assembly 200 can further comprise an outlet 208 by which the atomized fuel stream 108 can exit the assembly and optionally directly enter the first mix zone 116. The atomizer assembly 200 can be configured for mounting in a structure of the first mix zone 116 through inclusion of a coupling 210. The coupling can comprise means to stabilize the atomizer assembly 200, such as a clamp and a gasket.

Figure 2A:
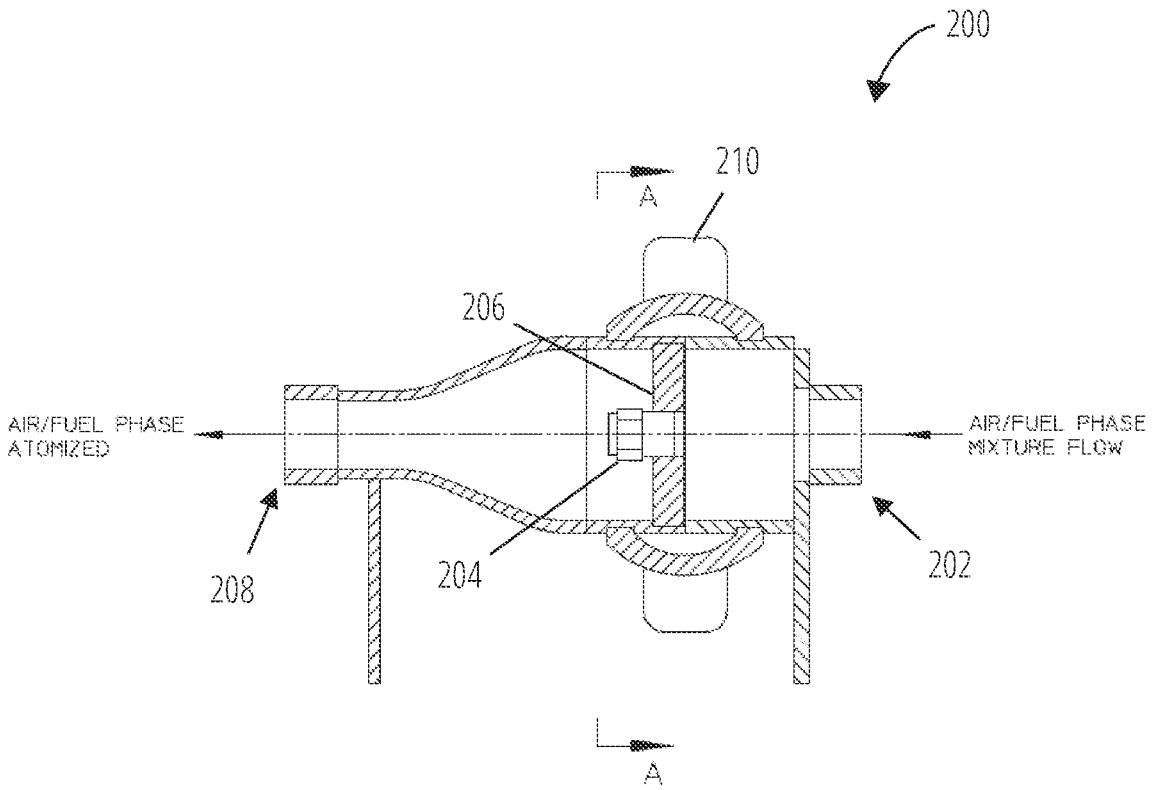
FIG. 2A is a cross-section view of an atomizer assembly for use in producing an atomized fuel stream according to an embodiment.
Figure 2B:
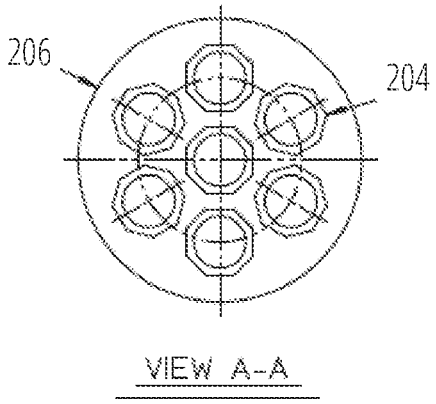
FIG. 2B is a cross-section of the view in FIG. 2A taken at the indicated transverse plane.
Figure 2C:
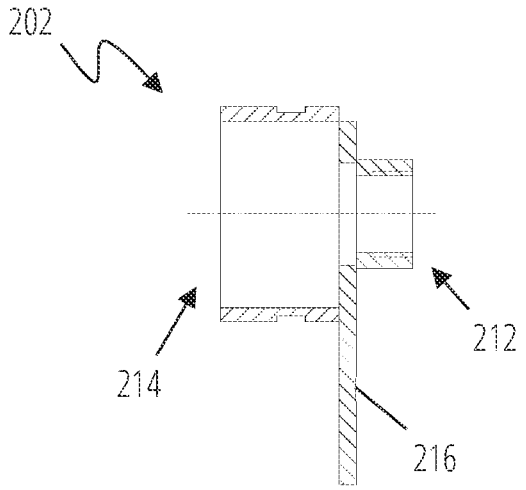
FIG. 2C is a cross-section view of a detail of the atomizer assembly of FIG. 2A.
Figure 2D:
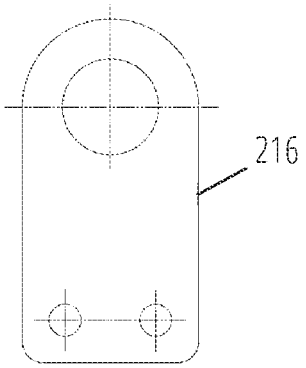
FIG. 2D is an end view of a detail of FIG. 2C.

FIG. 2C and FIG. 2D show further details of the inlet 202, which can comprise an inlet first end 212 configured for fluid connection with the source of the fuel-gas mixture, and an inlet second end 214 configured to direct the mixture to the at least one atomizer nozzle 204. As shown in cross-section in FIG. 2C and in the end view of FIG. 2D, the inlet 202 can also include an inlet mounting plate 216 by which the atomizer assembly 200 can be secured to a surface, e.g., an outer surface of the first mix zone 116.

Figure 2E:
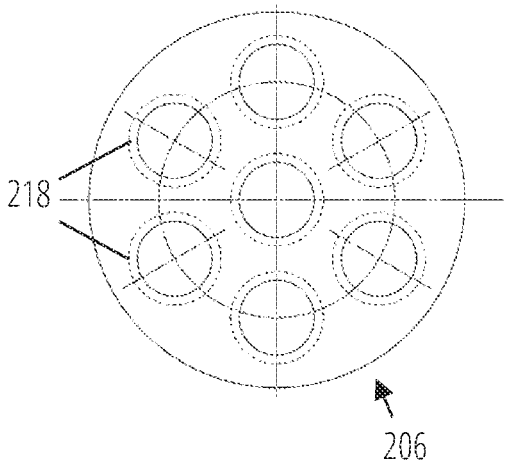
FIG. 2E is an end view of a detail of the atomizer assembly of FIG. 2A.
Figure 2F:
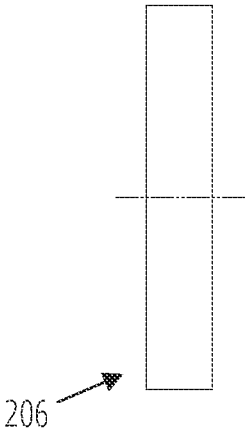
FIG. 2F is a side view of the detail of the atomizer assembly shown in FIG. 2E.

FIG. 2E and FIG. 2F show further details of the nozzle plate 206 in an end view and a side view, respectively. The nozzle plate 206 can include one or more nozzle mounting holes 218, each of which can accommodate an atomizer nozzle 204 (not shown). In some embodiments, a nozzle mounting hole 218 and corresponding atomizer nozzle 204 each may include matched threading to facilitate securement of the atomizer nozzle 204 in the nozzle plate 206.

Figure 2G:
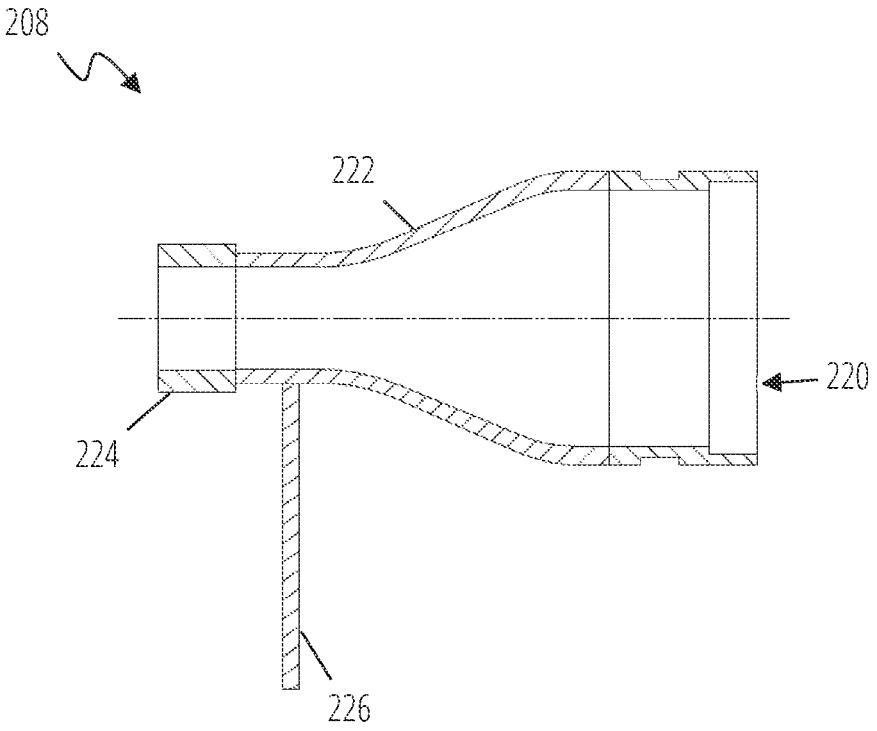
FIG. 2G is a cross-section view of another detail of the atomizer assembly of FIG. 2A.
Figure 2H:
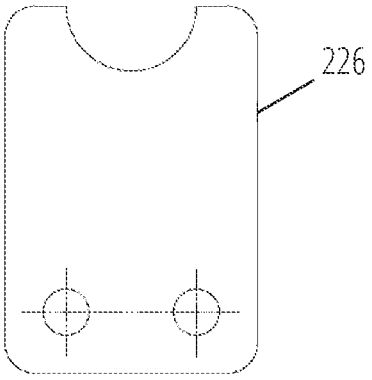
FIG. 2H is an end view of a detail of FIG. 2G.

FIG. 2G and FIG. 2H show further details of the outlet 208 of the atomizer assembly 200, which can comprise an outlet first end 220 for receiving the output of the at least one atomizer nozzle 204 and a reducer 222 configured to focus and direct said output to the outlet second end 224, where the focused atomized fuel stream 108 leaves the assembly. As shown in cross-section in FIG. 2G and in the end view of FIG. 2H, the outlet 208 can also include an outlet mounting plate 226 by which the atomizer assembly 200 can be secured to a surface, e.g., an inner surface of the first mix zone 116.

As noted above, the water-in-oil emulsion explosives described herein contain an inorganic oxidizer salt solution as the discontinuous phase of the emulsion. Any oxidizer phase known in the art and compatible with the fuel phase and an emulsifier, if present, may be used. Examples of the oxidizer phase include, but are not limited to, oxygen-releasing salts. Examples of oxygen-releasing salts include, but are not limited to, alkali and alkaline earth metal nitrates, alkali and alkaline earth metal chlorates, alkali and alkaline earth metal perchlorates, ammonium nitrate, ammonium chlorate, ammonium perchlorate, and mixtures thereof, such as a mixture of ammonium nitrate and sodium or calcium nitrates.

In some embodiments, a process flow for forming an emulsion explosive can comprise incorporation of the oxidizer salt solution into the emulsion over plural steps. As shown in FIG. 1, an oxidizer salt solution 110 is pumped through a flow divider 112 that divides (e.g., bifurcates) the oxidizer salt solution 110 into a plurality of oxidizer streams. For example, the flow divider 112 may direct a first portion of the oxidizer salt solution 110 to a first oxidizer stream 114 that leads to a first mix zone 116, while the flow divider 112 also directs a second portion of the oxidizer salt solution to a second oxidizer stream 118 that bypasses the first mix zone 116 and leads to a second mix zone 120. In some embodiments, an equal amount of oxidizer salt solution 110 is directed to the first oxidizer stream 114 (i.e., toward the first mix zone 116) and to the second oxidizer stream 118 (i.e., toward the second mix zone 120). In other embodiments, a higher percentage of the oxidizer salt solution 110 is directed to the second oxidizer stream 118 than to the first oxidizer stream 114. For example, in some embodiments, 55% to 65% of the oxidizer salt solution 110 is directed to the second oxidizer stream 118, while 35% to 45% of the oxidizer salt solution is directed to the first oxidizer stream 114. Alternatively, a higher percentage of the oxidizer salt solution 110 may be directed to the first oxidizer stream 114 than to the second oxidizer stream 118. In other embodiments, instead of being connected to a single flow divider, the plurality of oxidizer streams are each connected to different containers of oxidizer salt solution.

After passing through the flow divider 112, the first portion of the oxidizer salt solution 110 enters into the first mix zone 116. The first mix zone 116 is configured to facilitate the mixing of the first portion of the oxidizer salt solution 110 with an amount of fuel delivered into the first mix zone 116 via the atomized fuel stream 108. The first mix zone 116 can include one or more inlets for receiving each of the first oxidizer stream 114 and the atomized fuel stream 108. The atomized fuel is injected into the first mix zone 116 as a dispersion of droplets. The inlet for the atomized fuel stream 108 may involve a part of the atomizer 106; for example, where the atomizer 106 comprises a nozzle, the orifice of the nozzle may be situated within or otherwise in fluid communication with the interior of the first mix zone 116. The oxidizer salt solution 110 can be pumped into the first mix zone 116. In some embodiments, the oxidizer salt solution and the atomized fuel are introduced into the first mix zone 116 simultaneously. In some embodiments, the oxidizer salt solution and the atomized fuel are introduced into the first mix zone 116 sequentially or in an alternating pattern.

The atomized fuel stream 108 and the first oxidizer stream 114 interact in the first mix zone 116 so as to accomplish mixing of the atomized fuel with the first portion of the oxidizer salt solution 110. As the atomized fuel comprises a combination of fine fuel droplets and expanding gas, the resulting product can be termed a fuel-rich emulsion explosive, that is, a sensitized fuel-oxidizer emulsion having a fraction of the total oxidizer content of the final product and also having bubbles of the atomizing gas distributed therein. The median gas bubble size in the fuel-rich emulsion explosive may be from about 0.5 μm to about 250 μm, or from about 20 μm to about 100 μm, or from about 40 μm to about 80 μm.

As the fuel-rich emulsion explosive exits the first mix zone 116, the fuel-rich emulsion explosive may have a relatively low viscosity, such as about 20 Pa·s or less, or about 2 Pa·s to about 8 Pa·s. The fuel-rich emulsion explosive exits the first mix zone 116 and is directed to the second mix zone 120, which also receives the second portion of the oxidizer salt solution 110 delivered via second oxidizer stream 118. The second mix zone 120 may be configured to receive these streams so as to facilitate mixing of the second portion of oxidizer salt solution 110 with the fuel-rich emulsion explosive. In some embodiments, the second portion of the oxidizer salt solution is about 45% to about 80%, or about 50% to about 70%, of the total amount of oxidizer salt solution 110 in the resulting emulsion on a weight per weight basis.

Mixing of the second portion of oxidizer salt solution 110 with the fuel-rich emulsion explosive results in a more balanced emulsion explosive with increased viscosity ("more balanced" referring to the oxygen balance of the emulsion explosive). In some embodiments, the viscosity of the more balanced emulsion explosive, relative to the fuel-rich emulsion explosive, is increased by about 6 Pa·s to about 20 Pa·s (e.g., by about 6 Pa·s to about 12 Pa·s; about 9 Pa·s to about 15 Pa·s, about 12 Pa·s to about 18 Pa·s, or about 15 Pa·s to about 20 Pa·s). The viscosity of the more balanced emulsion explosive may be about 20 Pa·s to about 35 Pa·s, such as about 20 Pa·s to about 26 Pa·s; about 23 Pa·s to about 29 Pa·s, about 26 Pa·s to about 32 Pa·s, or about 29 Pa·s to about 35 Pa·s.

The more balanced emulsion explosive may then enter into a homogenizer 122. The homogenizer 122 may manipulate the more balanced emulsion explosive to alter the size distribution of oxidizer salt solution droplets in the emulsion. For instance, in some embodiments, the homogenizer 122 disrupts relatively large droplets of oxidizer salt solution, thereby converting such droplets into smaller droplets that have a narrower size distribution. Pressurizing the second oxidizer stream 118 may provide at least a portion of the pressure necessary to homogenize the more balanced emulsion explosive. Homogenization may also reduce gas bubble size and make the distribution of the gas bubbles more uniform (i.e., more homogeneous) in the emulsion. In some embodiments, the gas bubble size in the homogenized emulsion explosive may be within a range of about 0.7 μm to about 250 μm, with a mean diameter of about 40 μm to about 80 μm.

Such manipulation of the oxidizer salt solution droplets may cause an increase (e.g., a significant increase) in the viscosity of the emulsion. For example, the viscosity of the homogenized emulsion explosive may be increased, relative to the more balanced emulsion explosive, by more than about 45 Pa·s, such as by at least about 50 Pa·s, at least about 60 Pa·s, at least about 80 Pa·s, at least about 100 Pa·s, at least about 150 Pa·s, or at least about 180 Pa·s. In some embodiments, the viscosity of the homogenized emulsion explosive may be increased by about 45 Pa·s to about 75 Pa·s, about 60 Pa·s to about 90 Pa·s, about 75 Pa·s to about 105 Pa·s, or about 90 Pa·s to about 140 Pa·s. For example, the viscosity of the homogenized emulsion explosive may be greater than or equal to 80 Pa·s. For example, the homogenized emulsion explosive may have a viscosity of about 80 Pa·s to about 300 Pa·s, such as about 80 Pa·s to about 100 Pa·s, about 90 Pa·s to about 120 Pa·s, about 105 Pa·s to about 135 Pa·s, about 120 Pa·s to about 150 Pa·s, about 135 Pa·s to about 170 Pa·s, about 160 Pa·s to about 190 Pa·s, about 180 Pa·s to about 220 Pa·s, about 200 Pa·s to about 250 Pa·s, or about 240 Pa·s to about 300 Pa·s.

The increased viscosity of the homogenized emulsion explosive may reduce gas bubble migration and/or gas bubble coalescence, thereby resulting in an emulsion explosive of increased compositional stability. In other words, due at least in part to the increase in viscosity of the homogenized emulsion explosive, the gas bubbles within the emulsion may have decreased mobility and/or a decreased propensity to merge with other gas bubbles. Embodiments of mechanically-gassed homogenized emulsion explosives described herein that have a relatively high viscosity may be more resistant to gas bubble migration and/or coalescence without the need for a bubble stabilization agent. However, effectively gassing higher viscosity emulsions such as the more balanced emulsion explosive and the homogenized emulsion explosive of the present disclosure may call for different technical approaches, as the viscous emulsion resists bubble creation. For example, more forceful approaches may be needed to mechanically gas high viscosity emulsions. The methods described above facilitate the production of high viscosity emulsion explosives, in that they involve commencing sensitization via mechanical gassing during the initial stages of emulsion formation.

The homogenized emulsion explosive may be delivered into a borehole 124 for detonation. Stated differently, the homogenized emulsion explosive may be delivered through a hose and placed within a borehole 124 for subsequent detonation.

One of ordinary skill in the art, with the benefit of this disclosure, would understand that any number of systems can be used to implement the processes described herein. Additionally, one of ordinary skill in the art, with the benefit of this disclosure, would understand that the mechanically-gassed homogenized emulsion explosives described herein may be additionally processed in other ways that are known in the art. For example, a lubricant, such as water, may be introduced while the homogenized emulsion matrix is delivered through a conduit to a borehole.

Additional components, such as solid sensitizers and/or energy increasing agents, may be mixed with the homogenized emulsion explosives. Examples of solid sensitizers include, but are not limited to, glass or hydrocarbon microballoons, cellulosic bulking agents, expanded mineral bulking agents, and the like. Examples of energy increasing agents include, but are not limited to, metal powders, such as aluminum powder, and solid oxidizers. Examples of the solid oxidizer include, but are not limited to, oxygen-releasing salts formed into porous spheres, also known in the art as "prills." Examples of oxygen-releasing salts include ammonium nitrate, calcium nitrate, and sodium nitrate. Any solid oxidizer known in the art and compatible with the fuel of the homogenized emulsion explosive may be used. The homogenized emulsion explosives may also be blended with explosive mixtures, such as ammonium nitrate fuel oil ("ANFO") mixtures.

The mechanically-gassed homogenized emulsion explosives described herein can be used as bulk explosives, both in above-ground and underground applications. All of the method steps described herein may be performed via a mobile processing unit. Once disposed within a borehole, the mechanically-gassed homogenized emulsion explosive may be detonated in any suitable manner. For example, the mechanically-gassed homogenized emulsion explosives described herein with low enough water may be sufficiently sensitized to be detonated with a No. 8 blasting cap when unconfined or in a borehole above the critical diameter for the particular density.

In accordance with the above description, the present disclosure encompasses sensitization of an emulsion explosive by introducing a compressed gas into the emulsion matrix prior to homogenization. This can be done at one or more points in the process flow e.g., during formation of the fuel-rich emulsion explosive, as well as prior to, during, and/or after formation of the more-balanced emulsion explosive. In another example, a process can comprise obtaining an emulsion matrix comprising a discontinuous phase of oxidizer salt solution droplets in a continuous phase of a fuel, wherein the emulsion matrix has an initial viscosity of about 4 Pa·s to about 20 Pa·s; mechanically introducing gas bubbles into the emulsion matrix to sensitize the emulsion matrix and form an emulsion explosive; and homogenizing the emulsion explosive to form a homogenized emulsion explosive with a viscosity of greater than or equal to 80 Pa·s (such as about 80 Pa·s to about 300 Pa·s, about 80 Pa·s to about 100 Pa·s, about 90 Pa·s to about 120 Pa·s, about 105 Pa·s to about 135 Pa·s, about 120 Pa·s to about 150 Pa·s, about 135 Pa·s to about 170 Pa·s, about 160 Pa·s to about 190 Pa·s, about 180 Pa·s to about 220 Pa·s, about 200 Pa·s to about 250 Pa·s, or about 240 Pa·s to about 300 Pa·s) and that is substantially devoid of a bubble stabilizing agent. In some embodiments, the gas bubbles (e.g., compressed gas) can be introduced prior to homogenization.

The present disclosure also encompasses methods and systems for manufacturing a mechanically-gassed emulsion explosive in which an emulsion may be at least partially sensitized at latter stages in the formation of the explosive, such as after homogenization. For example, a compressed gas may be combined with an emulsion during or after delivery of the emulsion into a borehole. This step may be the sole sensitizing treatment applied to the emulsion, or it may follow one or more prior sensitizing steps such as those discussed above.

As stated above, an emulsion explosive can be delivered into a borehole via a conduit which can include, e.g., a hose configured for insertion into the borehole. In some embodiments, a conduit can be configured to convey parallel streams of an emulsion and a compressed gas. For example, the conduit may include elements that provide separate fluidic connection to sources of these streams, e.g., to a reservoir containing an emulsion matrix and to a reservoir of compressed gas and/or to a gas supply. The conduit can be further configured to combine these streams at a point proximal to an outlet of the conduit so as to introduce bubbles of the compressed gas into the emulsion to produce a sensitized emulsion explosive.

Figure 3:
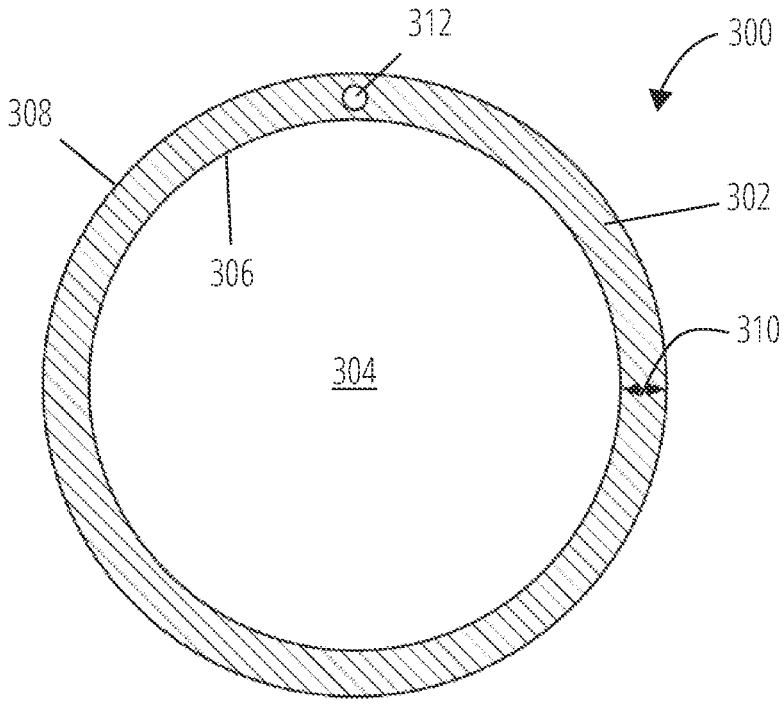
FIG. 3 is a cross-section view of a component of a system for delivering an emulsion explosive in accordance with an embodiment.

FIG. 3 illustrates a cross-section slice of one embodiment of a conduit 300 adapted for this use. In this embodiment, conduit 300 comprises a flexible tube 302. Flexible tube 302 comprises a first annulus 304 comprising inner surface 306 and outer surface 308. Inner surface 306 is separated from outer surface 308 by first thickness 310. First annulus 304 is configured to convey a stream of an emulsion matrix. In some embodiments, first annulus 304 may be fluidically connected to the output of a homogenizer so as to convey a stream of a homogenized emulsion product produced by the homogenizer.

Flexible tube 302 further comprises a second annulus 312 radially offset from first annulus 304. Second annulus 312 is radially located, relative to the center of first annulus 304, between inner surface 306 and outer surface 308. The diameter of second annulus 312 is less than the length of first thickness 310. Second annulus 312 is configured to convey a stream of compressed gas. The longitudinal length of second annulus 312 may be substantially equal to or greater than the longitudinal length of first annulus 304. The second annulus 312 can be approximately parallel (e.g., longitudinally) to first annulus 304. In some embodiments, the second annulus 312 may form a substantially helical or spiral path around the first annulus 304. In such cases, the length of the second annulus 312 can be greater than that of the first annulus 304 so as to convey their respective streams to a common location.

In FIG. 3, second annulus 312 defines a separate tube within the sidewall of the flexible tube 302. In an alternative embodiment, a separate tube may be located external to flexible tube 302 for conveying the compressed gas stream. For example, the separate tube may be attached to the outer surface 308 of flexible tube 302. Further alternatively, the separate tube may be located internal to flexible tube 302, such as attached to inner surface 306.

Figure 4:
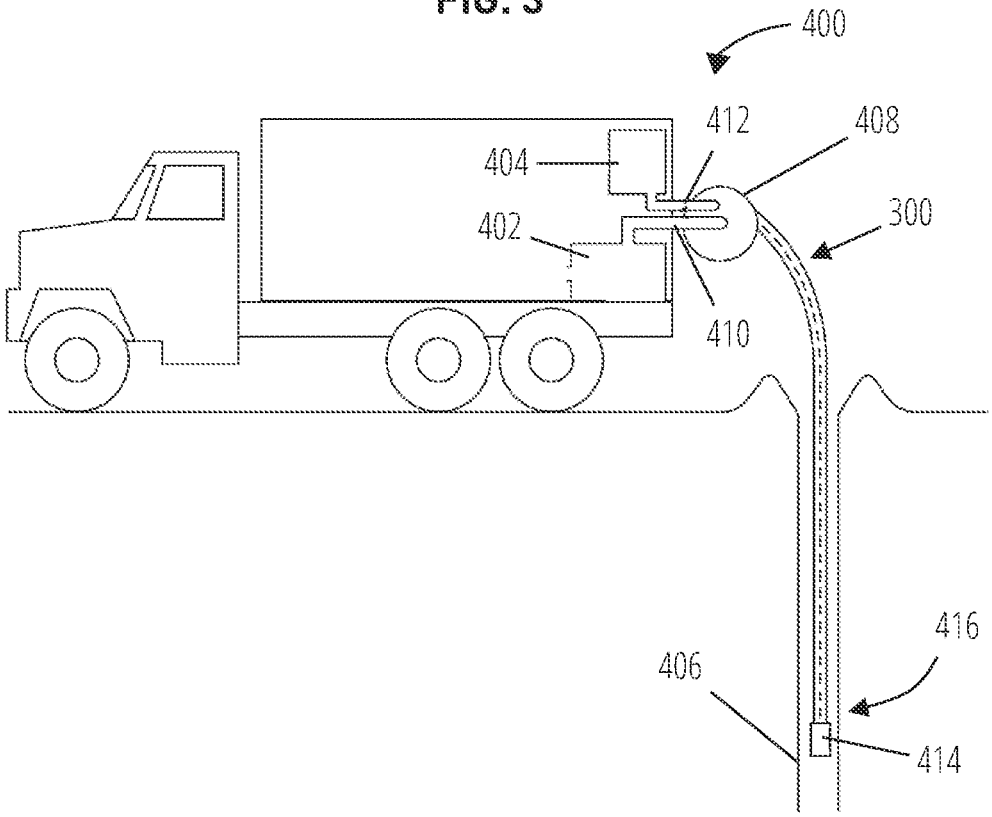
FIG. 4 illustrates a system for delivering an emulsion explosive in accordance with an embodiment.

FIG. 4 illustrates a sideview of a truck 400 equipped with a conduit 300 such as described above. FIG. 4 illustrates a reservoir 402 for an emulsion matrix and a compressed gas supply 404 mounted on the truck 400. FIG. 4 presents a simplified truck 400 which, in some embodiments may house other components for preparing an emulsion explosive that may be situated upstream of the reservoir 402 that are not shown. For example, the reservoir 402 may be a component of a system for manufacturing an emulsion explosive that is mounted on the truck 400. In some embodiments, this system may be a system for manufacturing a mechanically-gassed emulsion explosive as described above, and the reservoir 402 may be a homogenizer. In some embodiments, the reservoir 402 is for storing a homogenized emulsion matrix prepared in a separate facility and then loaded onto the truck 400. Truck 400 is positioned near vertical borehole 406. Conduit 300 is unwound from a hose reel 408 and inserted into the vertical borehole 406. Reservoir output 410 fluidically connects reservoir 402 to first annulus 304 (not shown) inside conduit 300. Gas output 412 fluidically connects the compressed gas supply 404 to the second annulus 312 (shown in phantom) of conduit 300, but is fluidically separated from reservoir 402.

The conduit 300 conveys homogenized emulsion from the reservoir 402 and compressed gas from the compressed gas supply 404 in substantially parallel streams to the borehole 406. The system may further comprise a structure configured to facilitate combining the streams to form the sensitized explosive product before said explosive is discharged from the outlet 416 of the conduit 300 and into the borehole 406. As shown in FIG. 4 the outlet 416 can include a nozzle 414 connected to the conduit 300 and configured to convey the sensitized explosive product to borehole 300. The inner surface of nozzle 414 may be mated with inner surface 306 of first annulus 304. Nozzle 414 may comprise at least one port configured for introducing the stream of compressed gas into the stream comprising the homogenized emulsion. The at least one port may connect the outer surface and the inner surface of the nozzle. The outlet of the second annulus 312 of flexible tube 302 may be fluidically connected to the outer surface of nozzle 414 and the at least one port. The outer surface of the nozzle 414 may include a channel for fluidically connecting the outlet of second annulus 312 to the at least one port of nozzle 414.

In some embodiments, the compressed gas may be introduced into the emulsion with sufficient pressure to accomplish mixing of these two components. In some embodiments, the nozzle 414 may include a mixing element situated within an inner surface of nozzle 414. The at least one port may be located upstream from the mixing element. The mixing element may be configured to accomplish initial or further sensitization of the emulsion explosive by mixing the compressed gas stream into the emulsion so as to produce gas bubbles within the emulsion. The mixer may comprise a static mixer. An example of a static mixer includes, but is not limited to, a helical static mixer. Any static mixer known in the art and compatible with mixing the emulsion with the compressed gas may be used.

In some embodiments, a homogenizer may be proximal to or incorporated into the nozzle. This may be a secondary homogenizer in addition to the homogenizer described above, where the secondary homogenizer is configured to further homogenize the sensitized emulsion explosive. The homogenizer may be a dynamic homogenizer, a static homogenizer or may comprise elements of both. An example of a dynamic homogenizer is a hydraulically or pneumatically-actuated shearing valve in which a hydraulic fluid or compressed air compresses or expands to some extent in response to the pressure of the emulsion explosive stream, allowing the valve seat to fluctuate slightly. This changes the amount of shear experienced by the stream of emulsion matrix, depending on the pressure of the emulsion matrix stream.

In contrast, an example of a static homogenizer is a shearing valve actuated by a threaded shaft (e.g., manual or motor-actuated). As pressure changes in the flowing emulsion matrix stream occur, the threaded shaft does not allow the valve seat to fluctuate much. The amount of shear experienced by the stream of emulsion explosive does not change much as the pressure of the emulsion matrix stream.

Any methods disclosed herein include one or more steps or actions for performing the described method. The method steps and/or actions may be interchanged with one another. In other words, unless a specific order of steps or actions is required for proper operation of the embodiment, the order and/or use of specific steps and/or actions may be modified. Moreover, sub-routines or only a portion of a method described herein may be a separate method within the scope of this disclosure. Stated otherwise, some methods may include only a portion of the steps described in a more detailed method.

Reference throughout this specification to "an embodiment" or "the embodiment" means that a particular feature, structure, or characteristic described in connection with that embodiment is included in at least one embodiment. Thus, the quoted phrases, or variations thereof, as recited throughout this specification are not necessarily all referring to the same embodiment.

Similarly, it should be appreciated by one of skill in the art with the benefit of this disclosure that in the above description of embodiments, various features are sometimes grouped together in a single embodiment, figure, or description thereof for the purpose of streamlining the disclosure. This method of disclosure, however, is not to be interpreted as reflecting an intention that any claim requires more features than those expressly recited in that claim. Rather, as the following claims reflect, inventive aspects lie in a combination of fewer than all features of any single foregoing disclosed embodiment. Thus, the claims following this Detailed Description are hereby expressly incorporated into this Detailed Description, with each claim standing on its own as a separate embodiment. This disclosure includes all permutations of the independent claims with their dependent claims.

Recitation in the claims of the term "first" with respect to a feature or element does not necessarily imply the existence of a second or additional such feature or element. It will be apparent to those having skill in the art that changes may be made to the details of the above-described embodiments without departing from the underlying principles of the present disclosure.'

What is claimed is:

1. A method of delivering an emulsion explosive, the method comprising:

dividing an oxidizer salt solution into a first portion and a second portion;

atomizing a fuel with a gas to form an atomized fuel, wherein the fuel is substantially devoid of a bubble stabilizing agent;

mixing the first portion of the oxidizer salt solution with the atomized fuel to form a fuel-rich emulsion explosive having bubbles of the gas dispersed therein, and having an initial viscosity;

mixing the fuel-rich emulsion explosive with the second portion of the oxidizer salt solution to form a more balanced emulsion explosive having an increased viscosity;

homogenizing the more balanced emulsion explosive to form a homogenized emulsion explosive having a further increased viscosity;

flowing the homogenized emulsion explosive through a conduit into a borehole; and introducing a stream of the gas into the homogenized emulsion explosive proximal to an outlet of the conduit.

2. The method of claim 1, wherein the initial viscosity of the fuel-rich emulsion explosive is of about 20 Pa·s or less.

3. The method of claim 1, wherein the increased viscosity of the more balanced emulsion explosive is about 6 Pa·s to about 20 Pas greater than the viscosity of the fuel-rich emulsion explosive.

4. The method of claim 1, wherein the viscosity of the homogenized emulsion explosive is increased by about 40 Pa·s to about 180 Pa·s relative to the more balanced emulsion explosive.

5. The method of claim 1, wherein the bubbles have a median bubble size of about 0.5 μm to about 250 μm.

6. The method of claim 1, wherein the second portion of the oxidizer salt solution is about 45% to about 80% of the total amount of the oxidizer salt solution on a weight-per-weight basis.

7. The method of claim 1, wherein the fuel further comprises up to 25 wt % of an emulsifier, a homogenizing agent, or combination thereof.

8. The method of claim 1, further comprising pressurizing the second portion of the oxidizer salt solution to provide at least a portion of the pressure necessary to homogenize the more balanced emulsion explosive.

9. A method of delivering an emulsion explosive, the method comprising:

inserting a conduit into a borehole;

flowing an emulsion matrix through the conduit;

introducing a compressed gas into the emulsion matrix proximal an outlet of the conduit to form an emulsion explosive; and conveying the emulsion explosive into the borehole.

10. The method of claim 9, wherein the emulsion matrix is a homogenized emulsion explosive.

11. The method of claim 9, further comprising mixing the emulsion matrix with the compressed gas proximal the outlet of the conduit.

12. The method of claim 9, comprising flowing the emulsion matrix and the compressed gas through the conduit in separate streams.

13. A system for delivering an emulsion explosive, comprising:

a reservoir configured to store an emulsion matrix;

a gas supply configured to produce a compressed gas;

a conduit configured for insertion into a borehole, wherein the conduit is fluidically connected to the reservoir and configured to convey the emulsion matrix, and wherein the conduit is also fluidically connected to the gas supply and configured to convey the compressed gas to a point proximal to an outlet of the conduit and introduce the compressed gas into the emulsion matrix at said point to form an emulsion explosive; and a nozzle located at and operably connected to the outlet of the conduit, wherein the nozzle is configured to convey the emulsion explosive to the borehole.

14. The system of claim 13, wherein the nozzle comprises at least one port configured for introducing the gas into the emulsion matrix at the point proximal to the outlet.

15. The system of claim 13, further comprising a mixer located proximal to the outlet of the conduit, wherein the mixer is configured to mix the emulsion matrix with the compressed gas.

16. The system of claim 13, further comprising a homogenizer located proximal the outlet of the conduit.

17. The system of claim 16, wherein the homogenizer is incorporated into the nozzle.

18. The system of claim 13, wherein the conduit comprises a flexible tube, wherein the flexible tube comprises a first annulus comprising an inner surface and an outer surface, wherein the inner surface is separated from the outer surface by a first thickness, wherein the first annulus is fluidically connected to the reservoir and is configured to convey the emulsion matrix to the point proximal to the outlet, and wherein the conduit further comprises a second annulus coextensive to the first annulus, wherein the second annulus is fluidically connected to the gas supply and is configured to convey the compressed gas to the point proximal to the outlet.

* * * * *